US005586352A

United States Patent [19]

O'Brien et al.

[11] Patent Number: 5,586,352

[45] Date of Patent: Dec. 24, 1996

[54] SUPPORT POLE WITH A PIVOTING AND LOCKING HANDRAIL FOR ELDERLY AND DISABLED PERSONS

[76] Inventors: John L. O'Brien, 1682 Station Boulevard, Ottawa, Ontario, Canada, K1G 0M2; Edward M. Thomas, 522 Gascon St. P.O. Box 131, Russell, Ontario, Canada, K4R 1E3; Donald A. N. Ed, 662 Windermere Ave., Ottawa, Ontario, Canada, K1S 2E2

[21] Appl. No.: 236,113

[22] Filed: May 2, 1994

[51] Int. Cl.[6] ..... A61G 12/00; A61G 7/053

[52] U.S. Cl. ..... 5/662; 5/81.1 R; 248/200.1

[58] Field of Search ..... 5/662, 658, 81.1; 248/200.1

[56] References Cited

U.S. PATENT DOCUMENTS

| | | | |
|---|---|---|---|
| 2,419,145 | 4/1947 | Kersenbrock et al. | 182/141 |
| 3,310,817 | 3/1967 | Harding | 5/662 |
| 4,457,502 | 7/1984 | Beach | 5/658 |
| 4,932,090 | 6/1990 | Johansson | 5/662 |

FOREIGN PATENT DOCUMENTS

| | | | |
|---|---|---|---|
| 172625 | 2/1986 | European Pat. Off. | 5/81.1 |
| 8202832 | 9/1982 | WIPO | 5/662 |

*Primary Examiner*—Alexander Grosz

[57] ABSTRACT

A support pole for elderly and disabled persons having a pivoting and locking horizontal handrail. It comprises a telescopic pole adapted to be vertically fixed between the floor and ceiling of a room and a horizontal handrail pivotally mounted thereon. A castellated collar and an engaging pin which is actuated by the handrail to move about the pole in small safe increments. The device is to be used by elderly or disabled persons to move from one position to another independent of any assistance.

12 Claims, 2 Drawing Sheets

FIG. 1
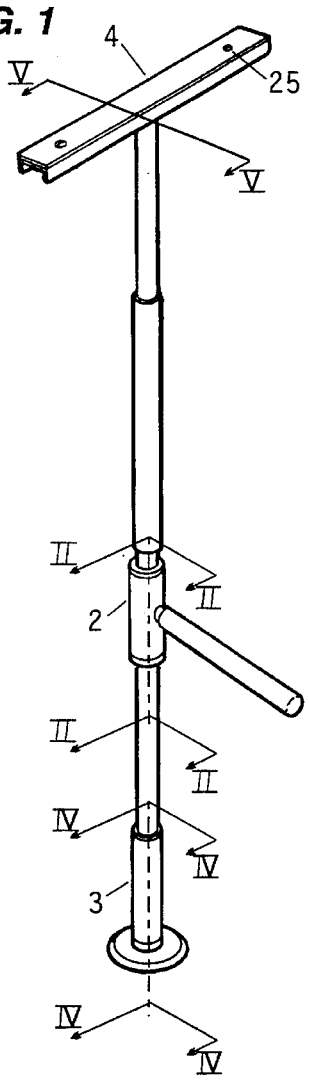
FIG. 2
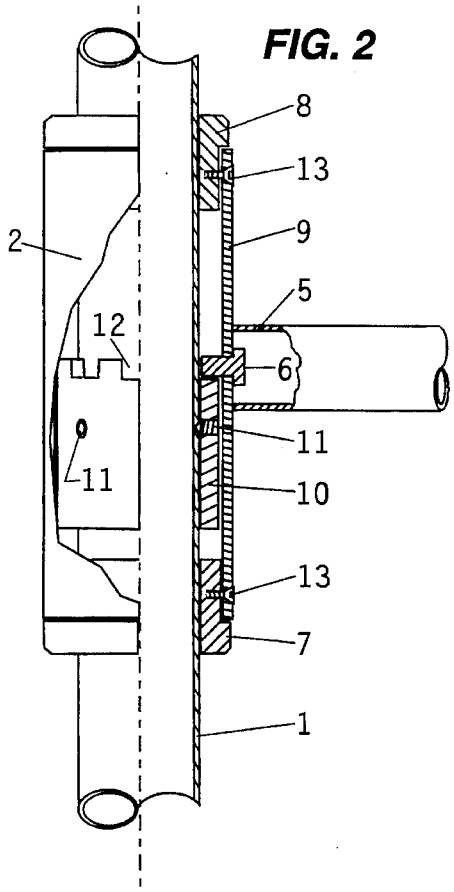
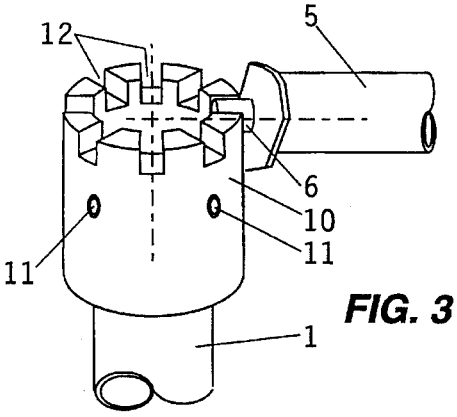
FIG. 3
FIG. 4
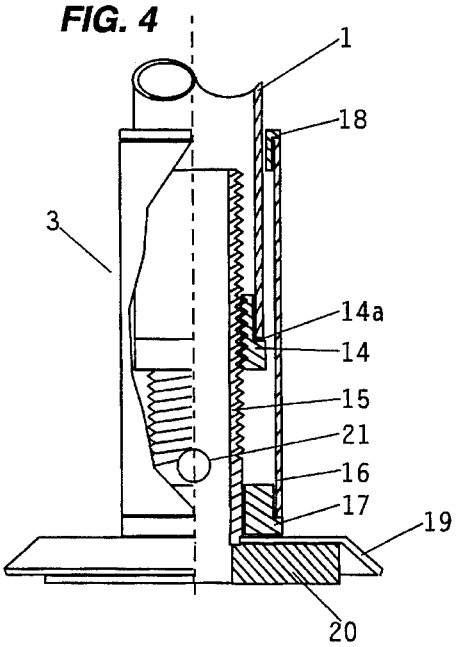
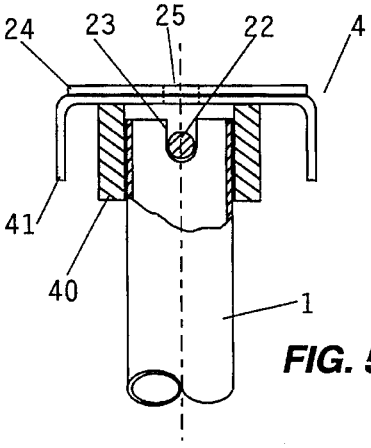
FIG. 5

SUPPORT POLE WITH A PIVOTING AND LOCKING HANDRAIL FOR ELDERLY AND DISABLED PERSONS

BACKGROUND OF THE INVENTION

This invention relates to a support pole with a pivoting and locking handrail for assisting disabled or elderly persons to move from one position to another independent of any assistance.

Elderly and disabled persons often require support surfaces such as hand rails to pull themselves up from a chair or wheelchair, support their weight while walking, lower themselves safely onto a toilet or bed, or most importantly, to have a secure grip surface on which to support themselves in the event of a sudden loss of balance, and thereby preventing a fall, which in more senior individuals, can result in a serious injury such as a broken hip.

Prior art devices for these purposes include wall mounted grab bars, mobile wheeled walkers, and floor to ceiling poles. However, each of these devices has its disadvantages: Wall mounted grab bars cannot provide support in the middle of a room, mobile wheeled walkers can slip, and occupy substantial space making them awkward to use in smaller areas of the home such as bathrooms. Ceiling to floor poles provide only a vertical surface, which by nature is difficult for a person's hand to grip with sufficient strength to bear a vertical load.

Typically, disabled and elderly persons require support during transfers from one position to another, such as from a bed to a wheelchair, wheelchair to a toilet seat, or wheelchair to a favourite sitting chair. The ease and safety of these transfers are limited by the design features of the support device that is used. i.e. a floor to ceiling pole provides the person with the ability to only perform a pivot transfer adjacent to the pole.

Clearly, no ideal support device exists in the prior art to cover the optimal requirements of: a device that provides support over the typical 3 to 5 foot range of travel during transfers, a device that provides a horizontal surface for easy grip by weak hands, a device which moves and locks at safe small increments, while minimizing occupied space.

SUMMARY OF THE INVENTION

The device comprises a pole adapted to be vertically fixed between the floor and ceiling of a room and a horizontal handrail unit pivotally mounted thereon to assist elderly and disabled persons to move from one position to another independent of any assistance.

The handrail unit consists of a horizontal tubular member fixed to a cylindrical member which rotates about the vertical axis of the fixed pole. When not in use, the handrail unit is in a locked position. As the user moves, the handrail may be unlocked by simply lifting up on the handrail, and moved in safe small increments.

Locking of the hand rail is established by a pin cooperating with a castellated collar which is fixed to the pole by allen screws, such that the cylindrical member slides over the castellated collar with clearance. The pin protrudes radially into the cavity of the cylindrical member to engage into any one of the grooves of the castellated collar thereby locking the pivotal movement of the hand rail. The height of the handrail is adjustable, and established by tightening the allen screws at the desired height.

Advantageously, the hand rail may operate with incremental locking positions when the pin engages the grooves of the castellated collar, or freely pivoting when the castellated collar is inverted and the pin contacts the smooth end.

BRIEF DESCRIPTION OF DRAWINGS

FIG. 1 is an isometric view of one embodiment of the invention.

FIG. 2 is a cutaway view of the handrail unit from line II—II—II—II.

FIG. 3 is a view of the castellated collar of FIG. 2.

FIG. 4 is a cutaway view of the base from lines IV—IV—IV—IV of FIG. 1.

FIG. 5 is a section of the line V—V of FIG. 1.

DETAILED DESCRIPTION OF THE PREFERRED EMBODIMENT

Figure 6A:
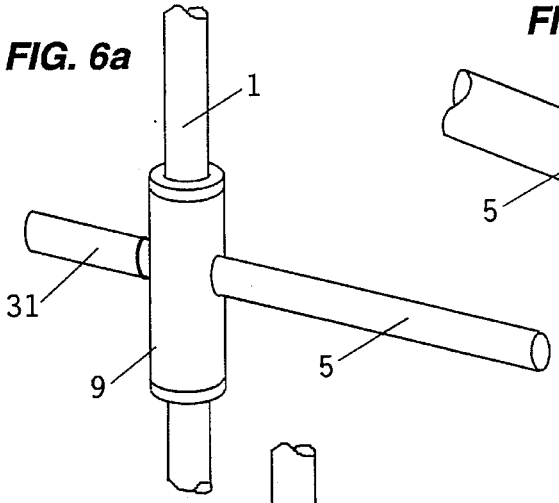
FIGS. 6*a* through 6*e* illustrate other embodiments of the invention.

This invention relates to a device for assisting elderly or handicapped individuals to move independently from one position to another. Determination for the preferred location of the device would be based on routine daily transfer requirements, for example from a bed to a walker or wheelchair, or from the walker or wheelchair to a toilet.

FIG. 1 shows the general appearance of the invention. Support pole 1 is anchored to the ceiling by the upper support beam 4 which has apertures 25 for fastening to ceiling members.

Base 3 has a screw jack arrangement to compress pole 1 between the floor and ceiling of a room.

The handrail unit 2 is pivotally mounted on pole 1 which allows the user to move the handrail unit about the pole in safe small steps.

FIG. 2 illustrates the components of the hand rail unit 2. Cylindrical member 9 has pin 6 protruding inward and handrail member 5 protruding radially outward. Plastic bearings 7,8 are anchored to the upper and lower ends of cylinder 9 by means of fasteners 13. Bearings 7,8 allow ease of pivotal movement for handrail unit 2 about pole 1. Collar 10 is castellated and the grooves 12 serve to engage pin 6 thereby allowing the user to move handrail member 5 from groove to groove in small safe increments.

Allen screws 11 are used to anchor collar 10 to pole 1 and also serve to provide height adjustment for handrail unit 2. Vertical adjustment is achieved by removing screw 13 from bearing 7 thereby allowing cylinder 9 to be moved up on pole 1 thereby exposing collar 10 so that the allen screws 11 can be loosened to adjust the collar 10 to the desired height for handrail unit 2.

FIG. 3 shows an unobstructed view of the collar 10 showing pin 6 in locked position with one of the grooves 12.

FIG. 4 details the arrangement of the base 3. Bottom end of pole 1 rests on the shoulder 14*a* of female thread member 14. Male thread member 15 rests on base plate 19 which has a resilient underpad 20. Hole 21 allows the jack pipe tool (not shown) to be inserted therein to rotate male threaded member 15 to expand pole 1 and compress it between the floor and ceiling of a room.

Cover member 16 can be moved up on pole 1 with its mounting bushing 18 to permit access to member 15 and in the closed position the bottom of cover member 16 engages bushing 17.

FIG. 5 provides the construction of the upper support beam 4. Pole 1 fits into bushing 40, and slot 23 engages pin 22. Bushing 40 is welded to the upper support beam member 41 which has a resilient pad 24 on it and apertures 25 in it to permit mounting to ceiling members.

FIG. 6*a* illustrates an additional embodiment of the invention. A short handrail member 31 is mounted on the opposite side of handrail member 5. A short handrail member 31 will provide greater security for individuals that may prefer a handrail on either side of the pole 1.

Figure 6B:
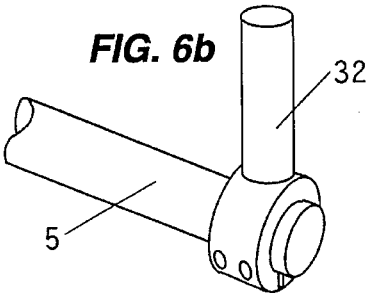

As found in FIG. 6*b* a vertical grip handle 32 is releasably secured to handrail member 5 and may be preferred by some users.

Figure 6C:
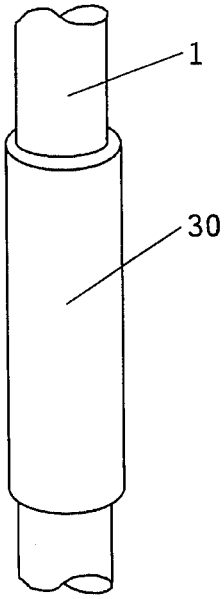

FIG. 6*c* has a vertically adjustable resilient cylindrical handgrip 30 located above handrail unit 2 on pole 1 which may be advantageous to certain individuals.

Figure 6E:
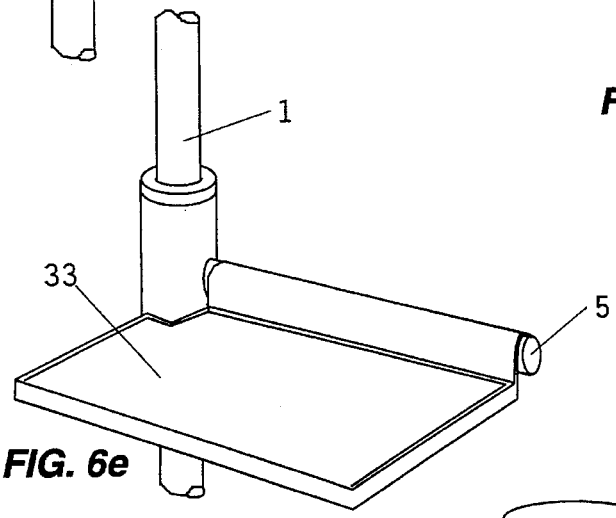
Figure 6D:
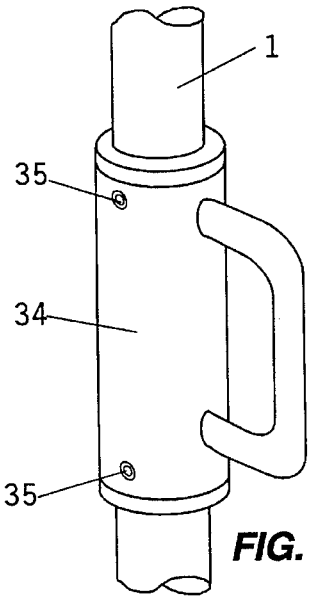

FIG. 6*d* displays the use of a c-shaped pivoted handle 34 on pole 1. Handle 34 is vertically adjustable by means of allen screws 35. FIG. 6*e* has a detachable tray 33 coupled on handrail member 5 to provide useful surface for people that have limited mobility.

Figure 7:
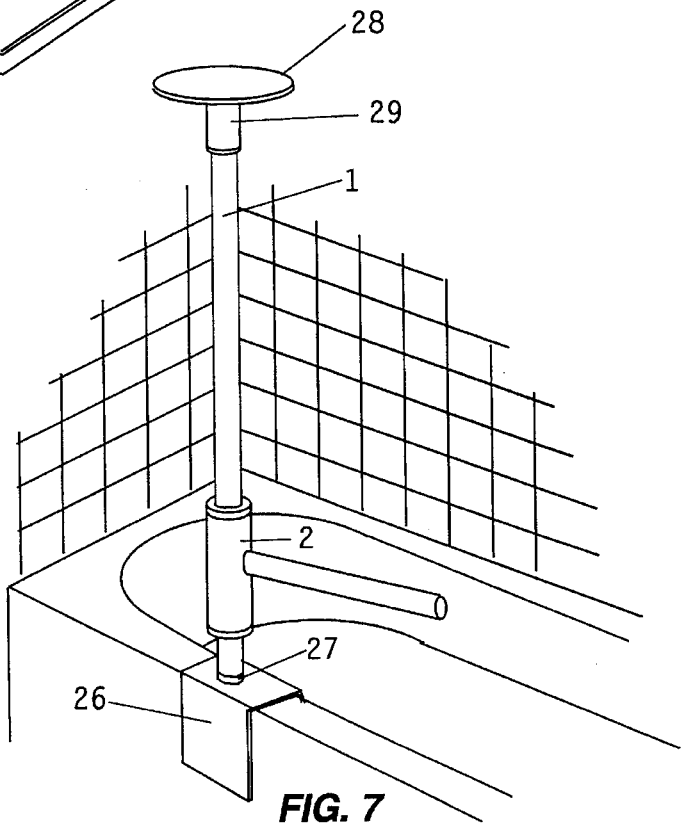
FIG. 7 is a view of an additional embodiment of the invention adapted for a bathtub.

FIG. 7 illustrates the unit mounted on the bathtub. The base is in the form of a inverted u-shaped member 26 with a collar 27 to hold pole 1. Jacking telescopic member 29 is near the top of pole 1 and a resilient covered member 28 serves to abut the ceiling. While the present invention has been explained in relation to its preferred embodiment, it will be understood that various modifications will be apparent to those skilled in the art upon reading the specification. Therefore it is understood that the invention disclosed herein is intended to cover all such modifications that fall within the scope of the appended claims.

We claim:

1. A support pole for assisting elderly and disabled persons with a pivoting and locking handrail unit comprising a pole member having means at its upper end and at its lower end to support said pole member in a vertical operating position wherein said hand rail unit comprises a cylindrical member having a tubular handrail member radially mounted thereon said handrail member being positioned below the upper end of the pole member and above the lower end of the pole member.

2. A support pole with a pivoting and locking handrail unit as claimed in claim 1 wherein said handrail unit has vertical adjustment means.

3. A support pole with a pivoting and locking handrail unit as claimed in claim 2 wherein said tubular handrail member has a grip surface thereon.

4. A support pole with a pivoting and locking handrail unit as claimed in claim 3 wherein said cylindrical member has cylindrical bearing members at its upper end and at its lower end, said bearing members movably engageable with said pole member on their inner surface, and removably and fixedly attached to the said cylindrical member on their outer surface.

5. A support pole with a pivoting and locking handrail unit as claimed in claim 4 wherein said pole member has a cylindrical collar adjustably mounted thereon, said cylindrical collar is located between the said cylindrical bearing members, said cylindrical collar having castellations on one end and having means to fixably and adjustably attach it to the said pole member.

6. A support pole with a pivoting and locking handrail unit as claimed in claim 5 wherein said cylindrical member has a pin extending radially inward, the said pin is adapted to engage and co-act with said cylindrical collar.

7. A support pole with a pivoting and locking handrail unit as claimed in claim 6 wherein said means at the upper end comprises a bridge plate member of c-shaped cross section, having a fixed collar thereon wherein said fixed collar has an aperture therein to provide means to anchor said pole member by pin means.

8. A support pole with a pivoting and locking handrail unit as claimed in claim 7 wherein said bridge plate member has resilient material fixed thereon.

9. A support pole with a pivoting and locking handrail unit as claimed in claim 8 wherein said means at the lower end comprises matching threading members, and a base plate member.

10. A support pole with a pivoting and locking handrail unit as claimed in claim 1 wherein said cylindrical member has an additional handrail mounted radially thereon.

11. A support pole with pivoting and locking handrail unit as claimed in claim 31 wherein said tubular handrail member has a grip handle detachably mounted thereon.

12. A support pole with a pivoting and locking handrail unit as claimed in claim 31 wherein said pole member has a cylindrical resilient grip member mounted thereon.

* * * * *